US008151595B2

(12) United States Patent
Kim

(10) Patent No.: US 8,151,595 B2
(45) Date of Patent: Apr. 10, 2012

(54) REFRIGERATOR WITH A DISPENSER IN A HOME BAR

(75) Inventor: Hyeong-Il Kim, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 525 days.

(21) Appl. No.: 12/300,324

(22) PCT Filed: Jun. 4, 2007

(86) PCT No.: PCT/KR2007/002707

§ 371 (c)(1),
(2), (4) Date: Mar. 27, 2009

(87) PCT Pub. No.: WO2007/142446

PCT Pub. Date: Dec. 13, 2007

(65) Prior Publication Data

US 2009/0308096 A1 Dec. 17, 2009

(30) Foreign Application Priority Data

Jun. 5, 2006 (KR) ..... 10-2006-0050556

(51) Int. Cl.

| | |
|---|---|
| ***F25D 3/00*** | (2006.01) |
| ***F25D 19/02*** | (2006.01) |
| ***F25D 25/00*** | (2006.01) |
| ***F25C 5/18*** | (2006.01) |
| ***A47B 96/04*** | (2006.01) |

(52) U.S. Cl. ..... 62/389; 62/448; 62/344; 62/377; 312/402

(58) Field of Classification Search ..... 62/389, 62/440, 448, 458, 131, 337, 377, 344; 222/146.6; 312/401–405

See application file for complete search history.

(56) References Cited

U.S. PATENT DOCUMENTS

| | | | | |
|---|---|---|---|---|
| 3,429,140 | A * | 2/1969 | White | 62/339 |
| 3,602,007 | A * | 8/1971 | Drieci | 62/344 |
| 2007/0119193 | A1 * | 5/2007 | Davis et al. | 62/135 |

FOREIGN PATENT DOCUMENTS

| | | | |
|---|---|---|---|
| KR | 10-2004-0042746 | A | 5/2004 |
| KR | 10-2004-0102571 | A | 12/2004 |
| KR | 10-2003-0070332 | * | 4/2005 |
| KR | 10-20050034422 | * | 4/2005 |
| KR | 10-2005-0071221 | A | 7/2005 |
| WO | WO-2004-085937 | A1 | 10/2004 |

* cited by examiner

*Primary Examiner* — Ljiljana Ciric
*Assistant Examiner* — Travis Ruby
(74) *Attorney, Agent, or Firm* — Birch, Stewart, Kolasch & Birch, LLP

(57) ABSTRACT

A refrigerator is provided with a home-bar and a dispenser. The refrigerator includes a body in which storage compartments are formed, a body door selectively opening/closing the storage compartments, a home-bar door provided in the body door, and a dispenser located directly in the home-bar door.

11 Claims, 4 Drawing Sheets

[Fig. 1]
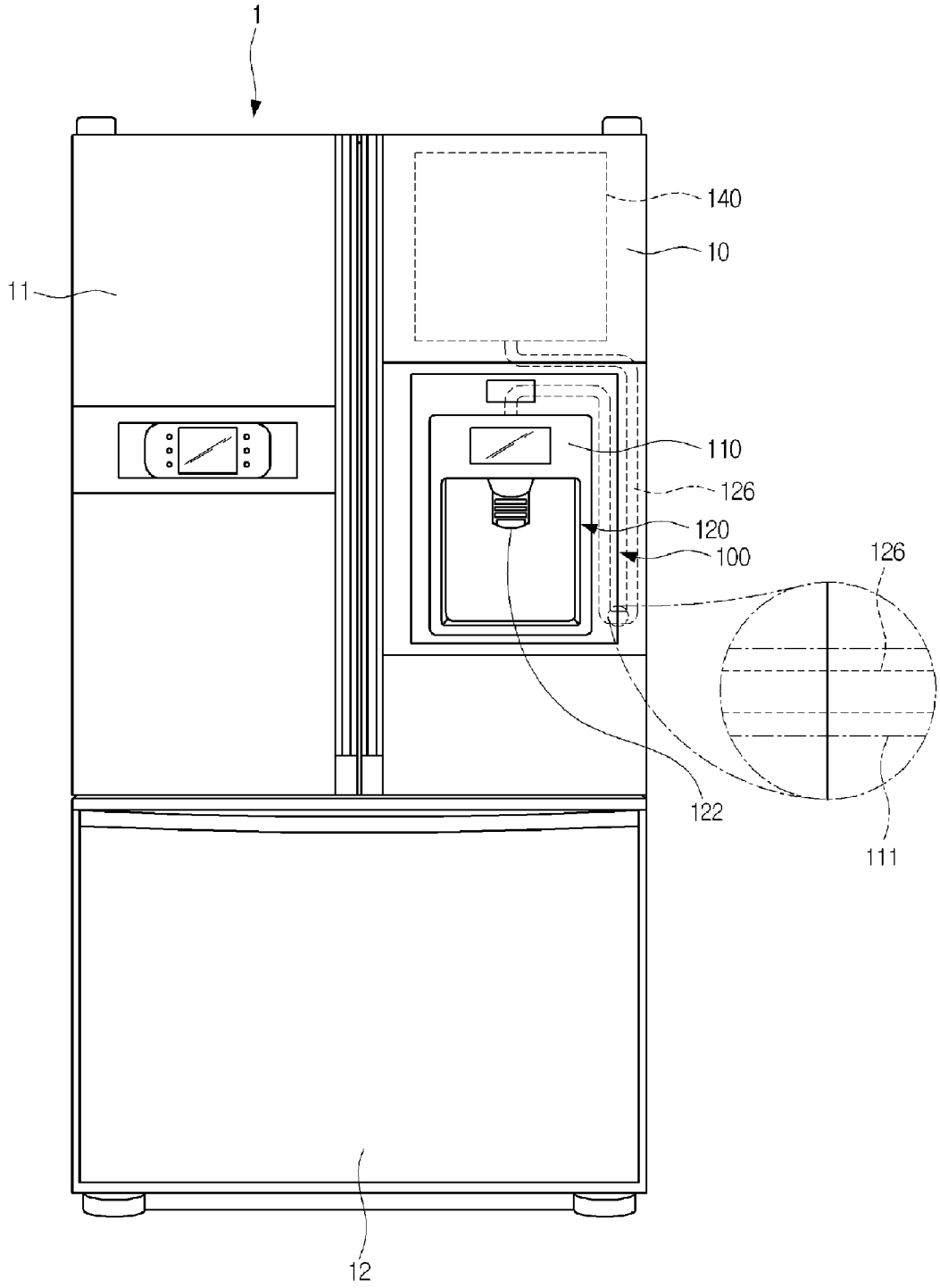

【Fig. 2】
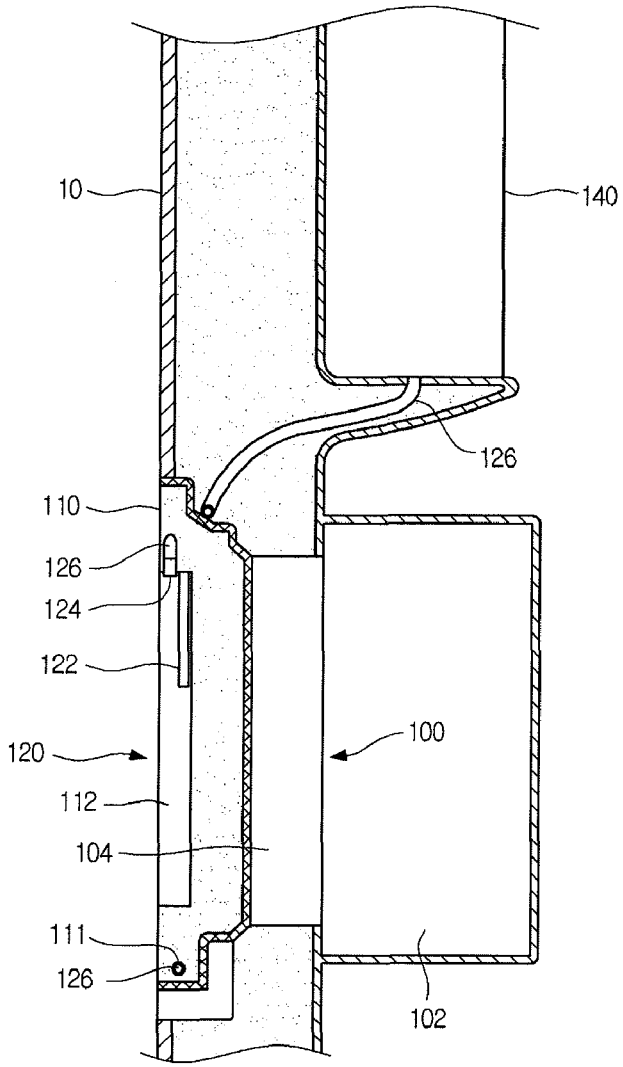
【Fig. 3】
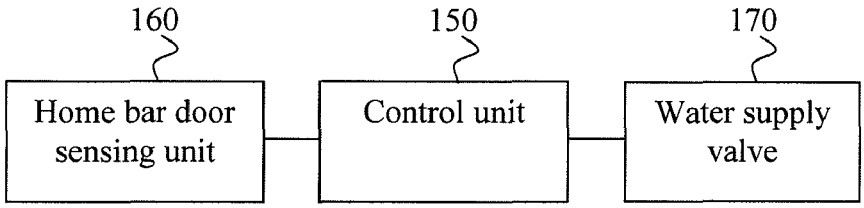

[Fig. 4]
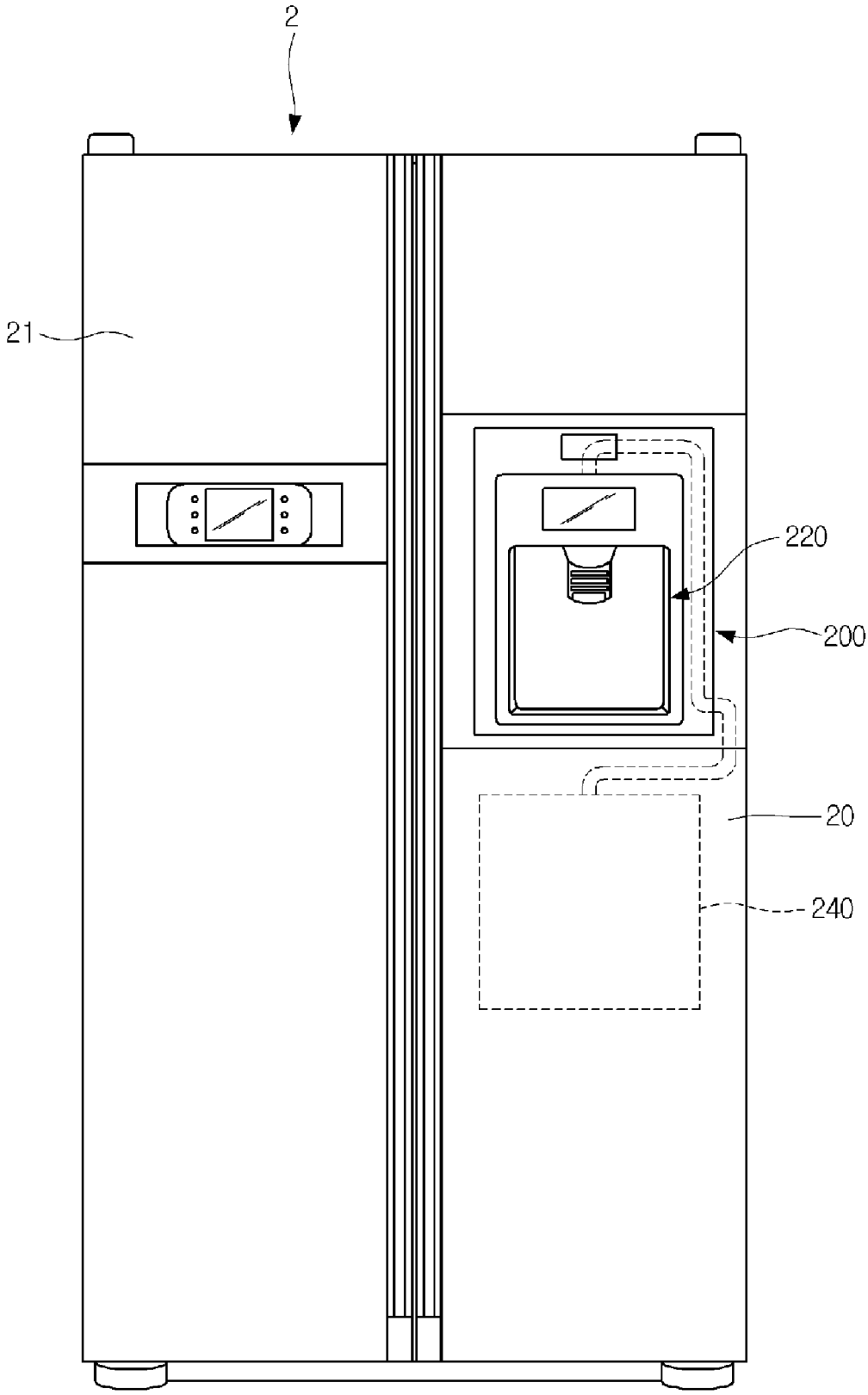

[Fig. 5]
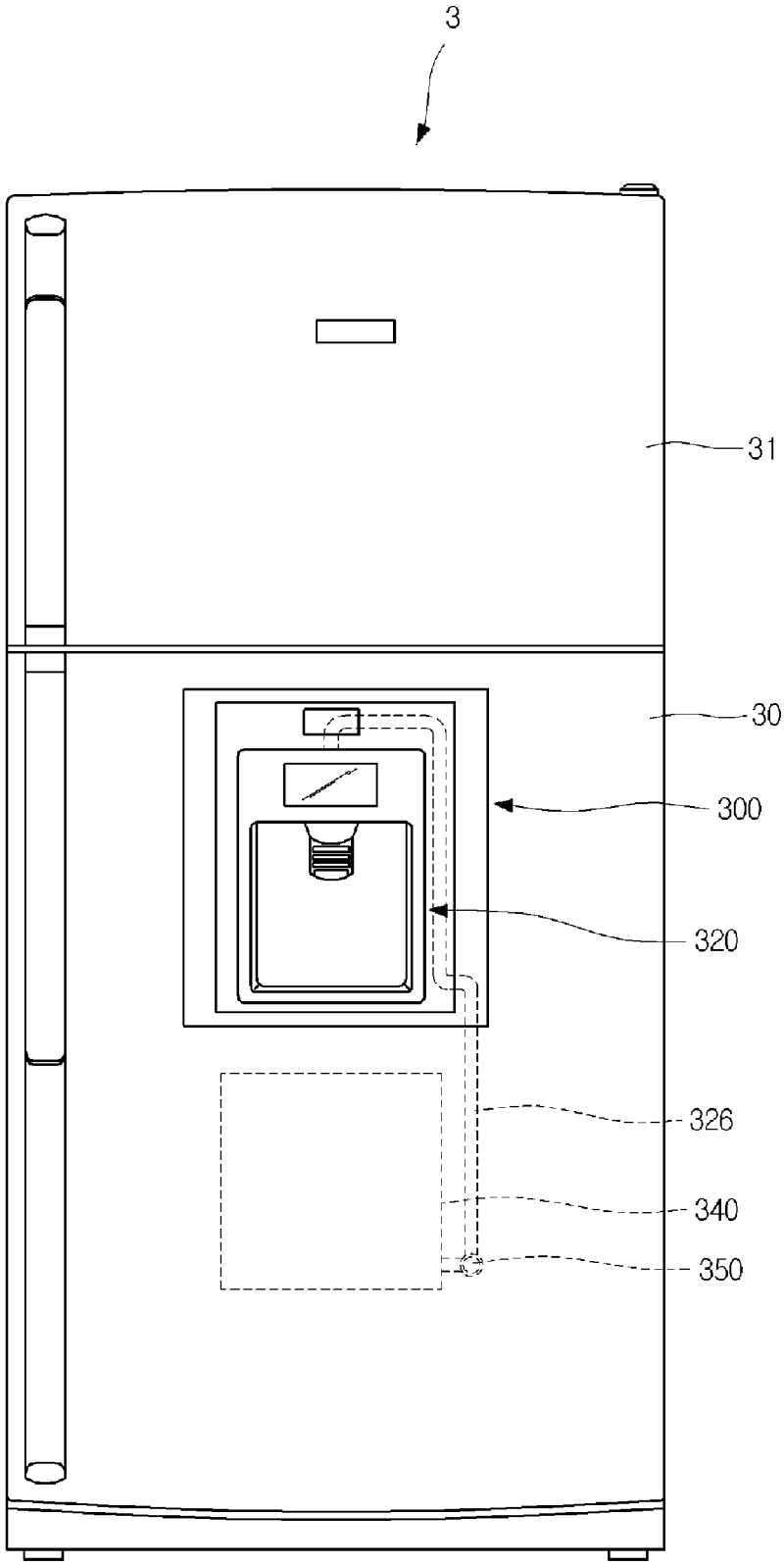

REFRIGERATOR WITH A DISPENSER IN A HOME BAR

TECHNICAL FIELD

The present invention relates to a refrigerator.

BACKGROUND ART

In general, a refrigerator is an appliance for keeping and storing foods for a long time by storing them inside the refrigerator at low temperature. The refrigerator includes a body provided with storage compartments in which foods are stored; a body door coupled to the body and selectively opening/closing the storage compartments.

Recently, a dispenser capable of taking out water or ice without opening the body door is provided on the body door. The dispenser is composed of a dispensing lever and a valve.

Also, a home-bar capable of taking out foods stored in the body without opening the body door is provided on the body door. Further, the home-bar is composed of an opening and a home-bar door selectively opening/closing the opening.

DISCLOSURE OF INVENTION

Technical Problem

An object of the present invention is to provide a refrigerator that a dispenser and a home-bar are installed on one door.

Another object of the present invention is to provide a refrigerator that the structure of the door is getting simple and workability is increased by providing the home-bar in the dispenser.

Technical Solution

A refrigerator according to one aspect of the present invention to achieve the above-mentioned objects includes a body provided with storage compartments inside the body; a body door selectively opening/closing the storage compartments; a home-bar door provided in the body door and selectively opening/closing the storage compartments; and a dispenser provided in the home-bar door and taking out water or ice to the outside.

A refrigerator according to another aspect of the present invention includes a body provided with a freezing chamber and a refrigerating chamber; a refrigerating chamber door selectively opening/closing the freezing chamber and the refrigerating chamber, respectively; a home-bar door provided in the refrigerating chamber door and selectively opening/closing the refrigerating chamber; a dispenser provided in the refrigerating chamber door and taking out water or ice to the outside; a water source supplying water to the dispenser; and a connecting pipe connecting the water source and the dispenser.

Advantageous Effects

In the refrigerator according to the preferred embodiments of the preset invention, it is possible to reduce man-hour and manufacturing costs thereof as well as to construct the refrigerator more simply, because the dispenser and the home-bar are provided in any one of body doors which open/close the storage compartments of the refrigerator as the home-bar door is provided in the dispenser.

In addition, there is an advantage in that it is possible to apply the dispenser and the home-bar to various types of refrigerators, because the dispenser and the home-bar are provided in one door as the home-bar door is provided in the dispenser.

In addition, it is possible to manufacture a refrigerator capable of realizing various functions, which may satisfy various needs of the consumer, because the dispenser and the home-bar may be provided in any one of body doors which open/close the storage compartments of the refrigerator and another member for a separate additional function may be provided in the other body door.

BRIEF DESCRIPTION OF THE DRAWINGS

FIG. 1 is a front view of a refrigerator according to a first embodiment of the present invention.

FIG. 2 is a side cross-sectional view illustrating the structure of a home-bar door according to a first embodiment of the present invention.

FIG. 3 is a block diagram illustrating the control structure of the refrigerator according to the first embodiment of the present invention.

FIG. 4 is a front view of a refrigerator according to a second embodiment of the present invention.

FIG. 5 is a front view of a refrigerator according to a third embodiment of the present invention.

MODE FOR THE INVENTION

Hereinafter, preferred embodiments of the present invention will be described in detail with reference to the accompanying drawings.

FIG. 1 is a front view of a refrigerator according to a first embodiment of the present invention, and FIG. 2 is a side cross-sectional view illustrating the structure of a home-bar door according to a first embodiment of the present invention.

Referring to FIGS. 1 and 2, a refrigerator, in which a refrigerating chamber is provided in an upper side and a freezing chamber is provided in a lower side, is proposed.

More particularly, a pair of refrigerating chamber doors 10, 11 and a freezing chamber door 12 disposed at a lower side of the pair of refrigerating chamber doors 10, 11 are provided in a refrigerator body 1 which forms an external shape of the refrigerator.

Further, the refrigerating chamber doors 10, 11 are hingedly coupled to one side of the refrigerator body 1, and thus they are rotatably provided in the refrigerator body 1. Further, the freezing chamber door 12 is slidably coupled to the refrigerator body 1 in such a manner that it can move back and forth.

Furthermore, the home-bar 100 is provided in any one of the refrigerating chamber doors 10, 11, which is the refrigerating chamber door 10 located at right side of the drawing in this embodiment of the present invention. The home-bar 100 is intended for the user to take out foods stored in the refrigerating chamber without opening the refrigerating chamber door 10.

The home-bar 100 includes a storage unit 102 in which foods are stored; an opening 104 formed at the refrigerating chamber door 10; and a home-bar door 110 selectively opening/closing the opening 104.

More particularly, the storage unit 102 may be a refrigerating chamber itself or an inside of a separate container connected to the interior of the refrigerating chamber door 11. According to the embodiment of the present invention, the storage unit 102 is an inside of a separate container connected to the interior of the refrigerating chamber door 11.

Further, the home-bar door 110 may rotate about the refrigerating chamber door 11 by a hinge axis 111 formed at lower part. The upper end of the home-bar door 110 rotates in up and down direction.

Meanwhile, a front of the home-bar door 110 is depressed into the inside at a predetermined depth, and the dispenser 120 is provided in a depressed region 111 of the home-bar door 110. The dispenser 120 is intended to dispense water or ice to the outside without opening the refrigerating chamber door 10.

Further, a dispensing lever 122 is provided in the depressed region 111 of the home-bar door 110. The dispensing lever 122 selectively operates a valve (which will be described in the following) or an ice moving means (not illustrated).

Further, a water outlet 124 is provided in the upper part of the dispensing lever 122. And, the water outlet 124 is exposed to the depressed region 111 of the home-bar door 110.

Further, a water storage unit 140, in which water to be drained through the water outlet 124 therefrom is stored, is provided in the inner part of the refrigerating chamber door 10. And, the water storage unit 140 is disposed at the upper part of the dispenser 120 so that water stored in the water storage unit 140 easily flows into the water outlet 124.

Further, the water storage unit 140 and the water outlet 124 are connected to each other by a connecting pipe 126. And, the connecting pipe 126 is connected to the water outlet 124 via an inside of the hinge axis 111 of the home-bar door 110. Therefore, the connecting pipe 126 maintains the connection with the water outlet 124 when the home-bar door 110 rotates. Also, the connecting pipe 126 is preferably made of a flexible material so that it is not distorted by a rotating movement of the home-bar door 110.

In addition, even though it is not illustrated, an ice maker may be provided in the inner part of the refrigerating chamber door 10 where the dispenser is located. The ice maker makes ice which is to be taken out to the outside through the dispenser 120. Here, the dispenser 120 may further includes an ice outlet (not illustrated) as well as the water outlet 124 from which water drains. Here, an ice duct for moving the ice generated from the ice maker is provided in the refrigerating chamber door 10 and the home-bar door 110 so that the ice may be discharged through the ice outlet.

FIG. 3 is a block diagram illustrating the control structure of the refrigerator according to the first embodiment of the present invention.

Referring to FIG. 3, the refrigerating chamber door 10 includes a home-bar door sensing unit 160 sensing whether or not the home-bar door 110 has been opened and closed or a valve 170 provided in the water storage unit 140, and a control unit 150 controlling the operation of the valve 170 in accordance with the opening and closing of the home-bar door 110.

More particularly, the control unit 150 controls to open the valve 170 only when the home-bar door sensing unit 160 senses the state that the home-bar door 110 is close.

That is, the water stored in the water storage unit 140 flows to the outside through the water outlet 124, only when the dispensing lever 122 is operated in the state that the home-bar door 110 is close.

Here, it is also possible that the ice is discharged to the outside through the ice outlet only when the home-bar door 110 is close as the valve 170 is provided in the ice duct.

Hereinafter, the workings of the preferred embodiments of the refrigerator according to the present invention will be described.

First of all, the storage unit 102 is opened by rotating the home-bar door 110 about the hinge axis 111 in the downward direction. And, the foods stored in the storage unit 102 are taken out, or the foods are received in the storage unit 102. After the withdrawal or receipt is completed, the storage unit 102 is closed by rotating the home-bar door 110 about the hinge axis 111 in the upward direction.

Meanwhile, the dispensing lever 122 is pressed in order to dispense water or ice through the dispenser 120. Here, the home-bar door sensing unit 160 senses whether or not the home-bar door 110 has been opened and closed.

Further, the control unit 150 controls to open the valve 170 only when the home-bar door 110 is close. After that, the water stored in the water storage unit 140 or the ice generated from the ice maker is supplied into the dispenser 120 and discharged to the outside through the water outlet 124 and the ice outlet.

According to this embodiment of the present invention, the discharge of the water or ice is prevented when the home-bar door 110 is open, even if the dispensing lever 122 is pressed. However, it is also possible that the dispensing lever 122 is not operated when the home-bar door 110 is open. In this case, a separate fixing device may further be provided therein, so that the dispensing lever 122 is locked when the home-bar door 110 is open and the dispensing lever 122 is operated when the home-bar door 110 is close.

FIG. 4 is a front view of a refrigerator according to a second embodiment of the present invention.

Referring to FIG. 4, a side by side type refrigerator, in which a freezing chamber and a refrigerating chamber are horizontally arranged side-by-side, is proposed.

Further, a refrigerating chamber door 20 is provided in the right side of the refrigerator body 2, and a freezing chamber door 21 is provided in the left side of the refrigerator body 2. Furthermore, a home-bar 200 is formed at the refrigerating chamber door 20, and a dispenser 220 is formed at the home-bar 200. And, a water storage unit 240 is provided in the upper part of the dispenser 220.

FIG. 5 is a front view of a refrigerator according to a third embodiment of the present invention.

Referring to FIG. 5, a refrigerator, in which a freezing chamber and a refrigerating chamber are vertically arranged, is proposed.

Further, a freezing chamber door 31 is provided in the upper part of the refrigerator body 3, and a refrigerating chamber door 30 is provided in the lower part of the refrigerator body 3. Furthermore, a home-bar 300 is formed at the refrigerating chamber door 30, and a dispenser 320 is formed at the home-bar 300.

Here, the home-bar 300 is located at the upper part of the refrigerating chamber door 30 for user's convenience. And, a water storage unit 340 is provided in the lower part of the home-bar 300. And, a pump 350 for pumping the water to the dispenser is provided in the connecting pipe 326 connecting the dispenser 320 with the water storage unit 340, or in the water storage unit 340.

Industrial Applicability

According to the preferred embodiments of the present invention, it is possible to reduce man-hour and manufacturing costs thereof as well as to construct the refrigerator more simply, and thus, embodiments of the refrigerator have high industrial applicability.

The invention claimed is:

1. A refrigerator, comprising:

a body provided with storage compartments inside the body;

a body door selectively opening/closing the storage compartments;

a home-bar door provided in the body door and selectively opening/closing the storage compartments; and a dispenser located directly in the home-bar door, for dispensing water or ice to the outside.

2. The refrigerator according to claim 1, wherein the body door includes a water storage unit in which water is stored and a connecting pipe connecting the water storage unit and the dispenser.

3. The refrigerator according to claim 2, wherein the home-bar door can rotate by a hinge axis of the body door, and the connecting pipe perforates into the hinge axis.

4. The refrigerator according to claim 1, wherein a depressed part is formed in the home-bar door so that a front of the home-bar door is depressed into the inside, and an outlet for dispensing ice or water is provided in the depressed part.

5. The refrigerator according to claim 1, further comprising:

a connecting pipe supplying the water fed from a water source to the dispenser, wherein the connecting pipe perforates into the side of the home-bar door.

6. The refrigerator according to claim 1, further comprising:

a connecting pipe supplying the water fed from a water source to the dispenser as it is connected to the dispenser;

a valve controlling the amount of the water flowing through the connecting pipe; and a sensing unit sensing whether or not the home-bar door has been opened and closed, wherein the valve is opened only when the sensing unit senses that the home-bar door is close.

7. A refrigerator, comprising:

a body provided with a freezing chamber and a refrigerating chamber;

a freezing/refrigerating chamber door selectively opening/closing the freezing chamber and the refrigerating chamber, respectively;

a home-bar door provided in the refrigerating chamber door and selectively opening/closing the refrigerating chamber;

a dispenser located directly in the refrigerating chamber door and dispensing water or ice to the outside;

a water source supplying water to the dispenser; and a connecting pipe connecting the water source and the dispenser.

8. The refrigerator according to claim 7, further comprising:

a valve controlling the amount of the water of the connecting pipe; a sensing unit sensing whether or not the home-bar door has been opened and closed; and a control unit controlling the operation of the valve in accordance with the opening and closing of the home-bar door.

9. The refrigerator according to claim 8, wherein the control unit controls to close the valve when the home-bar door is open, and the control unit controls to open the valve when the home-bar door is close.

10. The refrigerator according to claim 7, wherein the water source is a water storage unit provided in the refrigerating chamber door.

11. The refrigerator according to claim 7, wherein the connecting pipe perforates into the hinge axis of the home-bar door.

* * * * *